United States Patent [19]

Zletz

[11] 3,981,812

[45] Sept. 21, 1976

[54] HIGH TEMPERATURE THERMALLY STABLE GREASES

[75] Inventor: Alex Zletz, Naperville, Ill.

[73] Assignee: The United States of America as represented by the Secretary of the Air Force, Washington, D.C.

[22] Filed: Jan. 14, 1976

[21] Appl. No.: 649,104

[52] U.S. Cl. ..... 252/49.6; 252/50; 252/51.5 R; 252/389 R

[51] Int. Cl.[2] ..... C10M 1/10; C10M 1/50; C10M 7/02; C10M 7/48

[58] Field of Search ..... 252/49.6, 50, 51.5 R, 252/389 R

[56] References Cited

UNITED STATES PATENTS

| | | | |
|---|---|---|---|
| 2,779,738 | 1/1957 | McBride | 252/49.6 |
| 3,061,545 | 10/1962 | Badger | 252/49.6 |
| 3,304,259 | 2/1967 | Wright | 252/49.6 |
| 3,518,188 | 6/1970 | Pirson et al. | 252/49.6 |
| 3,575,860 | 4/1971 | Lee et al. | 252/49.6 |

*Primary Examiner*—Delbert E. Gantz
*Assistant Examiner*—I. Vaughn
*Attorney, Agent, or Firm*—Joseph E. Rusz; William J. O'Brien

[57] ABSTRACT

A lubricating grease compound of a perfluoropolyether lubricant vehicle thickened with a mixture of a substituted polyphenylene and a silicone fluid.

1 Claim, No Drawings

HIGH TEMPERATURE THERMALLY STABLE GREASES

STATEMENT OF GOVERNMENT INTEREST

The invention described herein may be manufactured and used by or for the Government for governmental purposes without the payment of any royalty thereon.

BACKGROUND OF THE INVENTION

This invention relates to lubricant greases and to a method for preparing the same. More particularly, this invention concerns itself with lubricating greases composed of perfluoropolyether fluids thickened with a thickening material composed of a mixture of a silicone fluid and a substituted polyphenylene.

The present utilization of machinery and equipment within high temperature and high stress environments has created a need for lubricating compositions that demonstrate a high degree of stability within such an environment. For example, loaded ball bearings are often required to perform in intermittent operations at high speed, high temperature and high pressure, and it has become increasingly difficult to formulate lubricants which fulfill the need for thermally stable greases.

The use of a perfluoropolyether fluid thickened to a grease consistency has been suggested as a material suitable for use in lubricating loaded bal bearings. It is also known that polyphenylene compounds are effective thickeners for perfluoropolyether. However, the resultant lubricant does not possess sufficient stability against the effects of thermal degradation to warrant its use at greatly increased temperatures.

With the present invention, however, it has been discovered that the addition of a silicone fluid improves the thickening efficiency of substituted polyphenylenes when the polyphenylenes are used to convert perfluoropolyether fluids to a grease consistency.

SUMMARY OF THE INVENTION

In accordance with the broad concept of this invention, thermally stable greases can be prepared by using silicone fluids as co-thickening agents to improve the thickening efficiency of substituted polyphenylene thickening agents used to thicken perfluoropolyether fluids to a grease consistency. The resulting grease is an especially effective lubricant for loaded ball bearings used in intermittent and continuous operations conducted at high speeds, high temperatures, and both high and low pressures.

Accordingly, the primary object of this invention is to provide lubricant greases which exhibit a high degree of stability to the degradative effects incurred during high temperature and high speed operations.

Another object of this invention is to provide a novel class of co-thickening agents capable of improving the thickening efficiency of substituted polyphenylene thickening agents.

Still another object of this invention is to provide a means for thickening perfluoropolyether fluids to a grease consistency that renders them useful and stable as lubricants for ball bearings operating at temperatures up to 600°F and speeds up to 45,000 rpm.

The above and still other objects and advantages of this invention will become readily apparent upon consideration of the following detailed description thereof.

DESCRIPTION OF THE PREFERRED EMBODIMENT

The present invention is predicated upon the discovery that silicone fluids unexpectedly improve the thickening efficiency of substituted polyphenylenes when used to convert perfluoropolyether fluids to a grease consistency. Polyphenylenes, such as nitropolyphenylenes and aminopolyphenylenes are effective thickeners for perfluoropolyether fluids. Surprisingly, however, it has been found that the addition of a small amount of silicone to perfluoropolyethers thickened by these substituted polyphenylenes results in increased consistency (stiffer grease) and permits the use of a small amount of thickener to achieve a given consistency. Addition of silicone to greases from perfluoropolyether thickened with unsubstituted polyphenylene, however, has no such effect.

The particular polyphenylenes found to be effective in this invention are given in Table I with abbreviations used as symbols for ease of reference. The molecular weights of the original polyphenylenes and the nitrogen content of the substituted polyphenylenes are also listed.

TABLE I

| | Abbreviation | Intrinsic Viscosity ($\eta$) RT | Mole Wt. | Nitrogen Content, Wt. |
|---|---|---|---|---|
| Polyphenylene | A | 0.07 | 4000 | |
| Polyphenylene | B | 0.08 | 6000 | |
| Polyphenylene | C | 0.09 | 6500 | |
| Nitropolyphenylene | A-$NO_2$ | — | 4000[a] | 3.5 |
| Nitropolyphenylene | B-$NO_2$ | — | 6000[a] | 2.3 |
| Nitropolyphenylene | C-$NO_2$ | — | 6500[a] | 2.3 |
| Aminopolyphenylene | B-$NH_2$ | — | 6000[a] | 2.3[b] |

[a]Molecular weight of polymer before nitration.
[b]Nitrogen content of nitrated polymer before reduction to amine.

The effect of silicone fluids on the thickening efficiency of substituted polyphenylenes is shown in Table II. The effect on penetration of silicone concentration of different silicones and of two different nitropolyphenylenes is also shown in Table II. Additions of Dow-Corning silicone fluid, F6-7039, to DuPont Krytox 143AD thickened with 6.0% C-$NO_2$ are shown first. For the highest concentrations of F6-7039, the required quantity of F6-7039 was added and the mixture passed through a three-roll mill three times. The greases with small concentrations of silicone were obtained by blending with silicone free grease and roll milling. The presence of free fluid shows that 10.0% F6-7039 is too much fluid to obtain a satisfactory grease at this thickener concentration. At from 6.0 to 0.75% F6-7039 smooth greases were obtained with increased consistency over the original grease. Dow-Corning fluids, fluorosilicone FS-1265, dimethyl silicone DC-200, and phenylmethyl silicone DC-550, each at 2.0%, increase the consistency of the original grease.

Another nitropolyphenylene was used in the last two examples of Table II. This polymer had a lower molecular weight and a higher $NO_2$ content than in the first example. In this grease DuPont corrosion inhibitor, M-4, was also present. It is seen that the addition of only 0.75% F6-7039 resulted in a sharp increase in consistency (drop in penetration).

TABLE II

| Components, Wt. % | | | Penetration |
|---|---|---|---|
| $C\text{-}NO_2$ | (a) Kr 143 AD | Silicone | ¼ Cone |
| 6.0 | 94.0 | None | 346 |
| 5.4 | 84.6 | (b) F6-7039, 10.0 | Fluid Present |
| 5.6 | 88.4 | F6-7039, 6.0 | 335 |
| 5.8 | 91.2 | F6-7039, 3.0 | 294 |
| 5.9 | 92.6 | F6-7039, 1.5 | 286 |
| 5.95 | 93.30 | F6-7039, 0.75 | 290 |
| 5.9 | 92.1 | (c) FS-1265, 2.0 | 316 |
| 5.9 | 92.1 | (d) DC- 200, 2.0 | 309 |
| 5.9 | 92.1 | (e) DC- 550, 2.0 | 298 |
| $A\text{-}NO_2$, 20.1 | 73.2 | None | 298 |
| | (f) M-4, 6.7 | | |
| $A\text{-}NO_2$, 19.95 | 72.65 | F6-7039, 0.75 | 226 |
| | M-4, 6.65 | | |

(a) A perfluorocarbon polyether fluid from E. I. DuPont de Nemours and Co.
(b) A high-phenyl content methyl phenyl silicone fluid from the Dow Corning Corporation.
(c) A fluorosilicone from the Dow Corning Corporation.
(d) A dimethyl silicone from the Dow Corning Corporation.
(e) A phenylmethyl silicone from the Dow Corning Corporation.
(f) A corrosion inhibitor from E. I. DuPont de Nemours and Co.

The effect of silicone fluids on thickening efficiency of substituted polyphenylenes and bearing life is also shown in Table III. It also gives additional examples on the effect of F6-7039 fluid on penetration of Krytox 143 AD thickened by $C\text{-}NO_2$ as well as the effect when $B\text{-}NH_2$ is used as a thickener.

TABLE III

| Sample No. | Composition, Wt. % Thickener | M-4 | Fluid[1] | Penetration ½ Cone | Bearing Life[2] at 550°F, Hrs. |
|---|---|---|---|---|---|
| 1 | $C\text{-}NO_2$, 12.0 | 3.1 | Kr, 84.9 | 304 | 295, 182 |
| 2 | $C\text{-}NO_2$, 11.5 | 7.4 | Kr, 81.1 | 309 | — |
| 3 | $C\text{-}NO_2$, 10.3 | 6.7 | Kr, 73.0<br>F6, 10.0 | 219 | — |
| 4 | $C\text{-}NO_2$, 9.4 | 6.1 | Kr, 75.4<br>F6, 9.1 | 297 | 194 |
| 5 | $C\text{-}NO_2$, 10.7 | 6.9 | Kr, 75.7<br>F6, 6.7 | 204 | 27 |
| 6 | $C\text{-}NO_2$, 4.76 | — | Kr, 88.86<br>F6, 6.38 | Fluid | — |
| 7 | $C\text{-}NO_2$, 9.09 | — | Kr, 84.82<br>F6, 6.09 | 238 | — |
| 8 | $C\text{-}NO_2$, 8.00 | — | Kr, 86.64<br>F6, 5.36 | 249 | — |
| 9 | $C\text{-}NO_2$, 6.25 | — | Kr, 88.90<br>F6, 4.45 | 279 | — |
| 10 | $C\text{-}NO_2$, 5.6 | — | Kr, 90.7<br>F6, 3.7 | 302 | 177 |
| 11 | $B\text{-}NH_2$, 12.2 | 2.5 | Kr, 85.3 | 302 | — |
| 12 | $B\text{-}NH_2$, 11.6 | 2.4 | Kr, 81.0<br>F6, 5.0 | 230 | 261 |

[1]Kr - Krytox 143 AD, from DuPont. F6 - F6-7039 fluid, from Dow-Corning.
[2]Run in MRC 204 S-17 test bearings at 10,000 rpm at 50 lbs radial and 25 lbs thrust loading.

In Table III, sample 1 is a $C\text{-}NO_2$ thickened Krytox with two bearing life tests shown. Sample 2 is a similar grease but with more M-4 additive. Sample 3 was obtained by adding enough F6-7039 to Sample 2 to give 10% F6-7039. The very marked increase in the thickening that results (309 to 219 pen) in this case where 10.3% thickener is present is in contrast to the result in Table II where only 6.0% thickener was present and fluid remained when 10% F6-7039 was present. Sample 4 was obtained by adding Krytox fluid to sample 3. The bearing life of sample 4 is within the range of those for sample 1. Sample 5 was prepared by adding F6-7039 to sample 2 and the lower penetration at the lower concentration of F6-7039 than in sample 3 (6.0 vs. 10.0) is consistent with the results presented in Table II. The short life of sample 5 may be due to the very low penetration or just an unusual result which occurs in bearing testing. In sample 6 the thickener was added to the white emulsion obtained by mixing Krytox fluid with F6-7039 fluid. Roll milling did not produce a grease as the product was still fluid. Addition of more thickener and milling resulted in a grease that had a low penetration (sample 7). Addition of Krytox fluid in three increments to sample 7 gave samples 8, 9, and 10. Sample 10 has about one-half the thickener concentration as samples 1 or 2 with the same penetration. Perhaps the M-4 additive had an adverse effect on efficiency in samples 1 and 2. The life of sample 10 is probably in the population of lives of samples 1 and 4. Sample 11 is a grease from aminopolyphenylene. Addition of F6-7039 yields sample 12 with a lower penetration and a good bearing life.

It is evident from these results that silicones improve the efficiency of nitropolyphenylene and aminopolyphenylene for thickening Krytox fluid. It has been shown that too much F6-7039 relative to thickener can result in a fluid product. On the other hand, this amount of silicone will probably vary with the particle size of the thickener, i.e., total surface area.

While this invention has been described with reference to various specific examples and embodiments, it should be understood that the invention is not limited thereto, but includes within its scope such modifications and variations as come within the spirit of the invention.

What is claimed is:

1. A lubricating grease composition composed of a mixture of from about 4 to about 13 percent by weight of a substituted polyphenylene thickening agent selected from the group consisting of nitropolyphenylene and aminopolyphenylene; from about 0.75 to about 10 percent by weight of a silicone co-thickening agent selected from the group consisting of dimethyl silicone and phenylmethyl silicone; and the balance substantially all a perfluoropolyether lubricating vehicle.

* * * * *